United States Patent [19]

Vähätalo

[11] Patent Number: 4,791,863

[45] Date of Patent: Dec. 20, 1988

[54] SYSTEM FOR CONTROLLING THE NIP PRESSURE PROFILE IN A ROLL PRESS

[75] Inventor: Harri Vähätalo, Jyväskylä , Finland

[73] Assignee: Valmet Paper Machinery Inc., Finland

[21] Appl. No.: 85,358

[22] Filed: Aug. 14, 1987

[30] Foreign Application Priority Data

Feb. 23, 1987 [FI] Finland ..... 870774

[51] Int. Cl.[4] ..... B30B 3/04; B30B 15/26

[52] U.S. Cl. ..... 100/35; 100/47; 100/162 B; 100/170; 72/243; 29/113.2

[58] Field of Search ..... 100/35, 47, 162 B, 170, 100/176, 156; 72/243; 137/85; 29/113 AD, 116 AD; 162/358, 360.1, 205

[56] References Cited

U.S. PATENT DOCUMENTS

| | | | |
|---|---|---|---|
| 4,074,624 | 2/1978 | Biornstad et al. | 100/35 |
| 4,464,921 | 8/1984 | Surat | 100/162 B |
| 4,480,537 | 11/1984 | Agronin et al. | 100/162 B X |
| 4,481,799 | 11/1984 | Glattfelder et al. | 100/162 B X |
| 4,537,050 | 8/1985 | Bryant et al. | 72/243 X |
| 4,576,682 | 3/1986 | Laapotti | 100/156 |
| 4,633,774 | 1/1987 | Kuosa et al. | 100/47 |
| 4,644,860 | 2/1987 | Brendel | 100/170 X |

OTHER PUBLICATIONS

Cadzow, J. A. and Martens, H. R., *Discrete-Time and Computer Control Systems*, Prentice-Hall, Inc. N.J., 1970, pp. 286–299.

*Primary Examiner*—Andrew M. Falik

*Attorney, Agent, or Firm*—Steinberg & Raskin

[57] ABSTRACT

Method and apparatus for controlling the transverse distribution of pressure applied to a web passing through a nip formed between a pressure zone-adjustable device having a first number (K) of separately adjustable pressure zones, including those for roll loading cylinders, if any, and a counter-member. A desired linear load profile comprising a second number (N) of setting zone set values for a corresponding number (N) of setting zones is provided, the second number (N) of the setting zones being substantially greater than the first number (K) of actual pressure zones. The second number (N) of setting zone set values are input to a zone conversion unit which is programmed with a mathematical model of the nip and are converted to a first number (K) of pressure zone set values so than an actual transverse distribution of pressure applied to the web is obtained having a minimal deviation from the setting zone set value distribution. In particular, the first number (K) of pressure zone set values are input into an intelligent regulating unit provided with diagnostic and protection logic so as to constitute set values for desired zone pressures. The pressure applied to each of the loading members or loading member groups of the nip to be controlled is determined separately by respective pressure zone set values.

15 Claims, 6 Drawing Sheets

SYSTEM FOR CONTROLLING THE NIP PRESSURE PROFILE IN A ROLL PRESS

BACKGROUND OF THE INVENTION

The present invention relates to a method for controlling the distribution of the pressure load applied to a web passing through a nip formed between a pressure zone-adjustable device, such as a variable-crown roll and/or a press-shoe apparatus, and its counter-member, such as a counter-roll, in a direction transverse to the running direction of the web, in which method loading elements acting upon the mantle or shell of a pressure zone-adjustable roll or the band of a press-shoe apparatus, such as glide-shoe groups supported against the central axle of the zone-adjustable roll, are used. The pressure generating actuator of the loading elements is controlled by means of a regulating unit.

The present invention also relates to apparatus for treating a web, such as a paper web, in a nip, such as a dewatering nip or a calendering nip, the apparatus including a zone-adjustable device, such as a variable-crown roll or a corresponding shoe device, and a counter-member, such as a counter-roll, which together form a nip through which the web to be treated is passed. The variable-crown roll or press-shoe device comprises a stationary part and a cylindrical mantle or band rotating around the stationary part, and a series of glide shoes or the like arranged between the stationary part and the mantle or band and grouped in pressure loading zones, each of which is loaded by means of zone pressures controlled by valves or the like. The apparatus further includes a regulating system which comprises a set value component, a limiter unit or corresponding processing unit, a regulator unit and an actuator unit which includes a series of pressure valves and a series of pressure-current converters or the like from which feedback signals are passed to the regulator unit.

In paper machines and after-treatment apparatus for paper, rolls are used to form dewatering press nips, smoothing nips or calendering nips in conjunction with counter-rolls. In such nips, it is important that the distribution of the linear load, i.e., the load profile, in the axial direction of the roll remains constant or that this profile can be adjusted as desired such, for example, in order to control the moisture profile and/or the thickness and/or the profile of any other corresponding property of the web, in the transverse direction of the web. For such purposes, various adjustable crown or variable-crown rolls are known by means of which the linear load distribution in a nip can be controlled.

Several different variable-crown or adjustable-crown rolls for paper machines are known. Generally, such rolls comprise a massive, stationary roll axle and a roll mantle rotatably mounted over the axle. Between the axle and mantle, glide-shoe arrangements and/or pressure-fluid chambers are arranged which act upon the inner surface of the mantle and which are divided or grouped into several parts or groups or zones in the axial direction of the roll so that the axial profile of the mantle at the nip can be aligned or adjusted as desired. As a rule, the nips formed by such rolls, such as press nips or calendering nips, are loaded by means of loading forces applied to the axle journals of the variable-crown roll and of its counter-roll.

An example of a variable-crown roll to which a method and apparatus in accordance with the invention can be advantageously applied is disclosed in Finnish Patent Application No. 864564, corresponding to pending U.S. application Ser. No. 034,167, now allowed, U.S. Pat. No. 4,757,585, owned by the assignee of the instant application.

As is known in the prior art, glide shoes loaded by means of cylinders provided with common hydraulic supply zones are used for controlling the deflection of variable-crown rolls. Each of the zones is controlled by means of a hydraulic valve which is specific to that zone. The number of glide shoes in different zones may be different from zone to zone as determined by the manner in which the compression force between the variable-crown roll and its counter-roll is to be controlled. Generally, one loading cylinder is provided at each end of the roll axle to produce the nip pressure together with the glide shoes.

It will be understood that as used herein, the adjustable zones of a pressure zone-adjustable device includes the loading members or groups of loading members extending axially along the length of the device as well as the loading members, if any, that load the ends of the device and produce the nip pressure.

Variable-crown rolls have found increasing use both in paper machines as well as in paper finishing machines and various after-treatment devices for paper. Such increased use is partly due to the fact that ever higher quality requirements are being imposed on paper products, i.e., various properties of the paper must be within ever stricter quality specifications both in the machine direction as well as in the transverse direction. At least one reason for the stricter quality standards is the advent of new copying and printing techniques which require extremely uniform paper quality in order to operate on a continuous basis. Pressure zone-adjustable devices, such as variable-crown rolls, can be used to positively affect various quality properties of paper.

Although the mechanical constructions of variable-crown rolls have been considerably developed in recent years, the same cannot be said about systems for regulating the variable-crown rolls. However, such regulating systems are very important where variable-crown rolls are used to control the quality properties of paper.

Conventional control or regulating systems for pressure zone-adjustable devices have the drawback that, even if the interaction of the compression forces produced by the different zone pressures in different zones of the zone-adjustable devices are taken into account, the operator only has a relatively small number of zones available for control in any attempt to regulate or control the profile of web properties in the transverse direction. An example of such a control system in use at present is disclosed in German Patent DE No. 3,117,516 corresponding to U.S. Pat. No. 4,464,921.

For example, considering an embodiment in which a variable-crown roll includes five pressure zones, it is possible using conventional regulating systems to set the linear load at five different points in accordance with five respective set values. If the length of the variable crown roll is, for example, ten meters, the points at which the linear load can be set are located about two meters apart from each other and it is not possible to control with any degree of accuracy the linear load acting in the areas between the points at which the linear loads are actually set. An increase in the number of actual pressure zones in the pressure zone adjustable-device results in a more complicated construction of the device, e.g., the variable-crown roll, and a greater possibility of malfunctioning so that this possbility is not a solution.

SUMMARY OF THE INVENTION

It is an object of the present invention to provide new and improved methods and apparatus for regulating pressure zone-adjustable devices, such as variable-crown rolls, so that the profile of the linear load in a nip formed between the device and its counter-member is more accurately adjustable without increasing the number of actual pressure zones.

Another object of the present invention is to provide new and improved methods and apparatus for controlling the transverse property profile of a web passing through a nip including a regulating system in which a certain amount of "intelligence" can be integrated, such as diagnostic and protection logic for the operation of a roll so that detrimental affects of various malfunctioning can be eliminated or at least minimized.

Briefly, in accordance with the method of the invention, these and other objects are obtained by providing a method wherein a number N of setting zones are used by means of which a setting zone set value distribution or profile of the pressure or load in the nip is set, the number (N) of setting zones being substantially greater than the number (K) of separately adjustable loading means or actual pressure zones of the zone-adjustable device, and wherein the number (N) of setting zone set values are converted, such as in a zone conversion unit, to a number (K) of pressure zone set values in accordance with a mathematical model of an adjustable nip or the like to obtain a linear-load profile or transverse pressure distribution whose deviations from the setting zone set value distribution are substantially minimized.

In accordance with the apparatus of the invention, the above-stated objects as well as others are attained by providing regulating equipment including a set value component that includes a setting zone unit in which a setting zone set value distribution can be set that comprises a number of setting zone set values, such as separate linear loads, for a corresponding number of setting zones, the number of setting zones (and setting zone set values) being substantially greater than the number of separately adjustable loading means or actual pressure or valve zones of the zone-adjustable device, and wherein the set value component further includes a zone conversion unit in which the setting zone set values are converted to pressure zone set values in a manner such that the material web will have a transverse distribution of pressure applied to it in the nip which differs from the setting zone set value distribution substantially minimally.

The invention makes it possible to control a transverse property profile of the web so that it follows the set property profile more accurately than has been possible in the case of the prior art since the operator of the zone-adjustable device can set the setting zone set value distribution or desired transverse pressure distribution as accurately as possible to obtain the desired transverse property profile. This objective is achieved by the invention in that the desired profile of the linear load in the nip between the zone-adjustable device and the counter-member is set at and defined by a substantially greater number of points in the transverse direction of the web than the total number of actual independent pressure zones (including loading cylinders) of the zone-adjustable device.

According to the invention, the setting zone set values are set substantially more densely in the transverse direction of the web, i.e., over a substantially larger number of setting zones, than the number of actual pressure zones of the zone-adjustable device. The desired setting zone set values are then converted in accordance with the invention in a novel manner to pressure zone set values, such conversion being carried out in a manner such that deviations from the desired linear-load distribution can be minimized.

The conversion from the higher number (N) of given desired values to the lower number (K) of guide values for zone pressures can be advantageously carried out using the so-called pseudo-inverse mathematical technique for the treatment of matrices.

According to a preferred embodiment of the invention, diagnostic and protective logic are integrated into the regulating system to minimize any detrimental effects of operational malfunctions.

DESCRIPTION OF THE DRAWINGS

A more complete appreciation of the present invention and many of the attendant advantages thereof will be readily understood by reference to the following detailed description when considered in connection with the accompanying drawings in which.

DETAILED DESCRIPTION OF THE PREFERRED EMBODIMENTS

Figure 1:
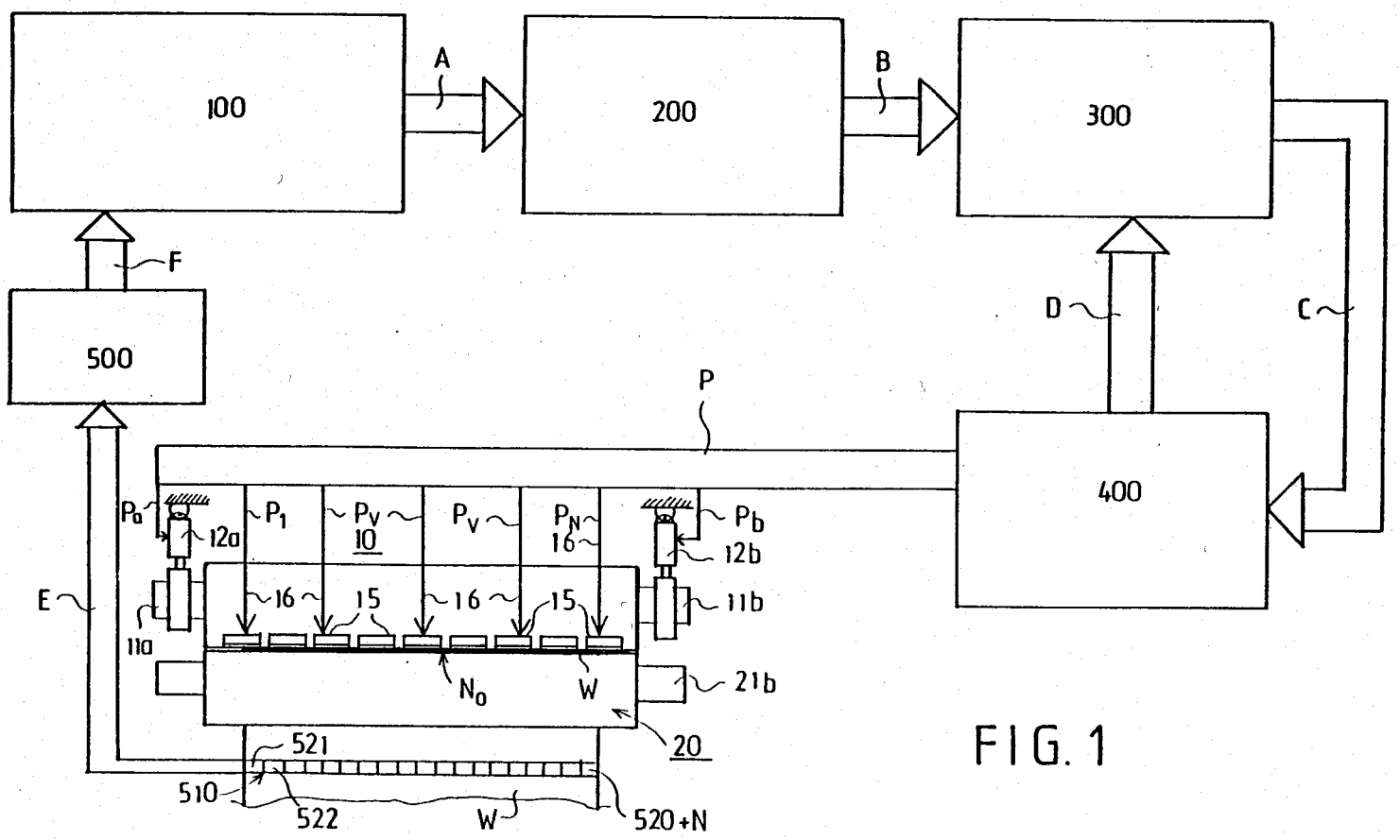
FIG. 1 is a block diagram showing the principle of a regulating system in accordance with the invention.
Figure 3:
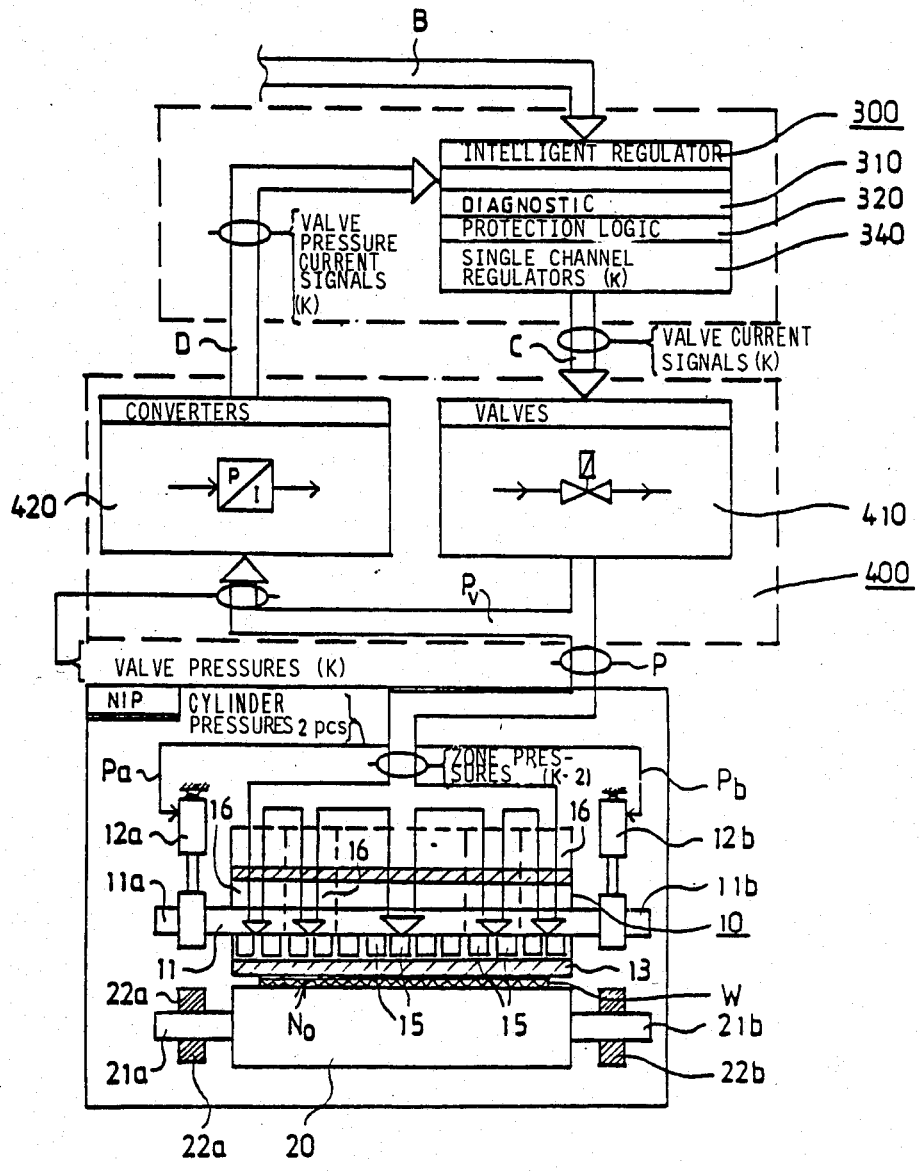
FIG. 3 is a schematic block diagram showing the regulator unit, the zone pressure actuator unit, and feedback units for use in a system in accordance with the invention as well as the connection of the regulator unit to a variable-crown roll to be regulated and to the nip formed by the roll.

Referring now to the drawings wherein like reference characters designate identical or corresponding parts throughout the several views, and more particularly to FIGS. 1 and 3, a brief description of the construction and operation of a variable-crown roll 10 which is regulated by means of a regulation system in accordance with the invention is illustrated. It is understood that a variable-crown roll comprises one of a number of possible pressure zone-adjustable devices which can be regulated by means of the present invention. The variable-crown roll 10 forms a nip $N_o$ with a counter-roll 20 through which a material web W to be treated is passed. The nip $N_o$ may comprise a dewatering press nip of a paper machine or a calendering nip of either a supercalender or of a machine stack. The linear or pressure profile in the nip $N_o$, i.e., the linear load or pressure distribution in the transverse direction of the web W, is regulated by means of the variable-crown roll 10.

The counter-roll 20 is provided with axle journals 21*a* and 21*b* which rotatably mount roll 20 in bearing supports 22*a* and 22*b* which may be provided with loading members. The variable-crown roll 10 includes a massive central axle 11 around which a cylindrical roll mantle 13 is rotatably mounted (FIG. 3).

Pressure cylinders load respective glide shoes 15 which act against the smooth inner surface of the roll mantle 13. The pressure cylinders 15 are divided into separate zones 16 in each of which hydraulic fluid under a certain zone pressure, regulated by means of the regulating system of the invention, is passed. The nip $N_o$ is loaded by loading cylinders 12*a* and 12*b* which act on the axle journals 11*a* and 11*b* of the central axle 11. The loading cylinders are loaded by means of hydraulic fluid under zone pressures $P_a$ and $P_b$ which are also regulated by the system of the invention.

Referring now to FIG. 1, the general principles of a regulating system in accordance with the invention will now be described. The system includes a set value component 100 which comprises a zone conversion unit 120 which generates pressure zone set values A for determining the actual zone pressures in the respective zones of the variable-crown roll 10 including the zone pressures $P_a$ and $P_b$, the total number of such actual pressure zones being designated K. The pressure zone set values A are input into a limiter unit 200 in which the pressure zone set values A are limited within selected maximum and minimum values to obtain limited pressure zone set values B. The limited pressure zone set values B, whose number is K, are input into an intelligent regulator unit 300, the output of which are valve current signals C, the number of which is also K. The valve current signals C are input to a zone pressure actuator unit 400 which includes pressure control valves 410 and converters 420 (FIG. 3). Signals indicative of valve pressures are transmitted from the zone pressure actuator 400 as feedback signals D, the number of which is also K, to the regulator unit 300. The zone pressure actuator 400 controls the valve pressures P which determine the actual pressures in the pressure zones 16 of the variable-crown roll 10, and the pressure zones $P_a$ and $P_b$ for the hydraulic cylinders 12*a* and 12*b* that load the axle journals 11*a* and 11*b* of the variable-crown roll.

In the embodiment of the regulating system shown in FIG. 1, a detector device 510 measures selected properties of the web W passing through the nip $N_o$, such as the moisture or caliper, in the transverse direction of the web. The detector sends a number N of measurement signals E to a feedback unit 500 which in turn sends a series of signals F to the set value component 100 which are used in controlling the same as described below. It is understood that the feedback unit 500 and associated equipment are not necessary to the operation of the regulating system of the invention.

The regulating or control system of the invention controls the distribution of the loading forces applied to the material web W passing between the zone-adjustable roll 10 and the counter-roll 20. As noted above, other zone-adjustable devices may be controlled in accordance with the invention, such, for example, as a device including a looped band against which glide shoes 15 are pressed by means of the hydraulic pressures provided to the control zones 16. Moreover, it is also possible to substitute for the counter-roll 20 a counter-member utilizing a component other than a cylindrical counter-surface, such, for example, as a moving band or a stationary member.

Assuming that the variable-crown roll has ten actual pressure zones 16 (including the pressure zones $P_a$ and $P_b$) i.e., K=10, the zone pressure actuator unit 400 includes ten converters 420 (FIG. 3) which measure the pressures in the actual pressure zones 16 and pressure zones for loading cylinders 12*a*, 12*b*. The pressure signals are converted to current signals D which are input to the intelligent regulator 300 to which the limited pressure zone set values B are also input from the limiter unit 200. The intelligent regulator 300 generates the current signals C, determined by the limited pressure zone set values B and current signals D, which are then input to the zone pressure actuator unit 400 to control the hydraulic valves 410 (FIG. 3), the number of which is ten.

Figure 5:
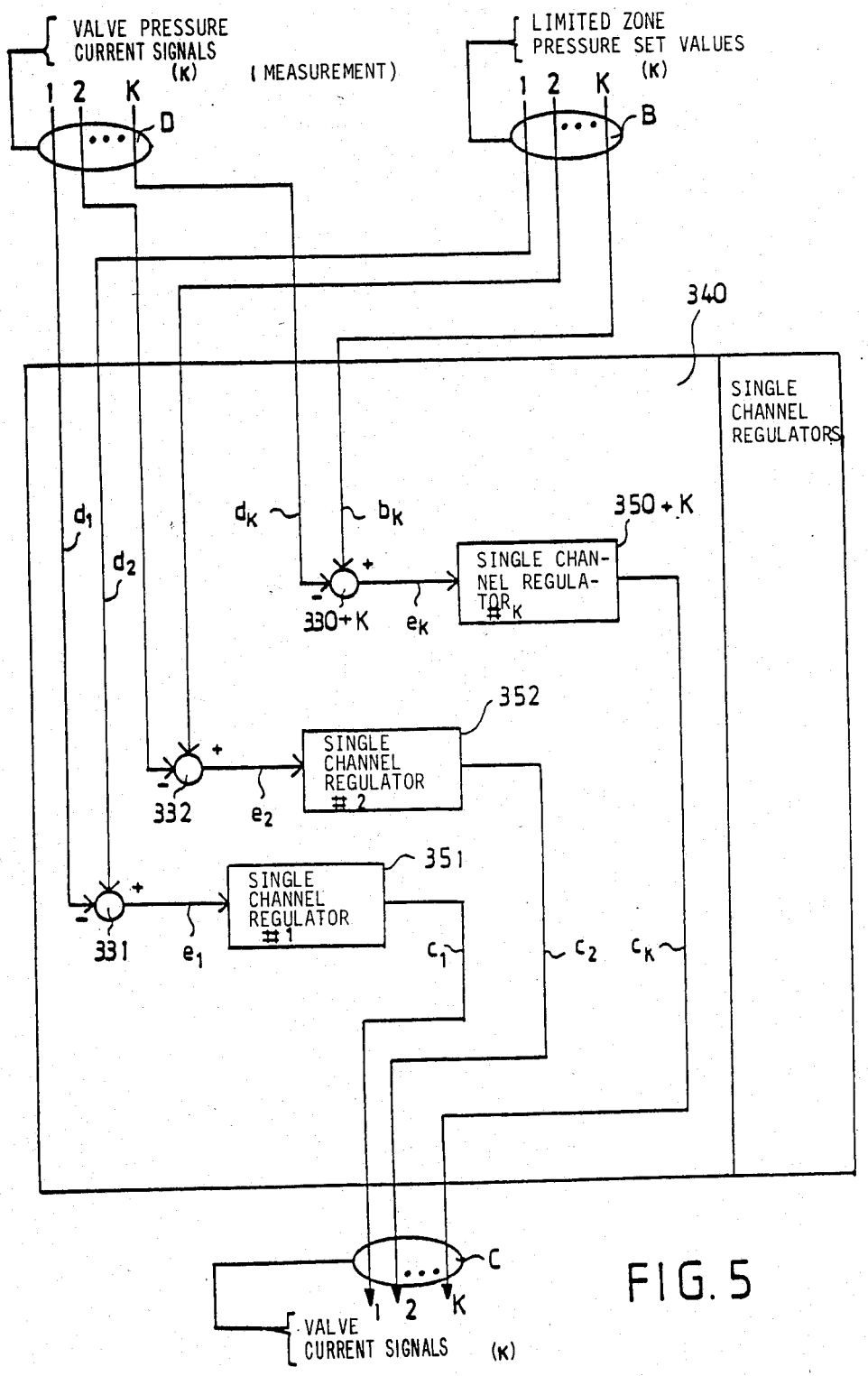
FIG. 5 is a block diagram showing an embodiment of a regulator unit including regulators for individual channels for use in accordance with the invention.

The intelligent regulator 300 may also include a diagnostic unit 310, a projection logic unit 320, and a single-channel regulator unit 340. In accordance with FIG. 3, the variable-crown roll 10 operates as desired when the the output pressures P determined by the valves 410 of the zone pressure actuator unit 400 correspond to the limited pressure zone set values B within desired tolerances. Each of the single-channel regulators 350 . . . 350+K operates independently from the other regulators (FIG. 5).

Figure 4:
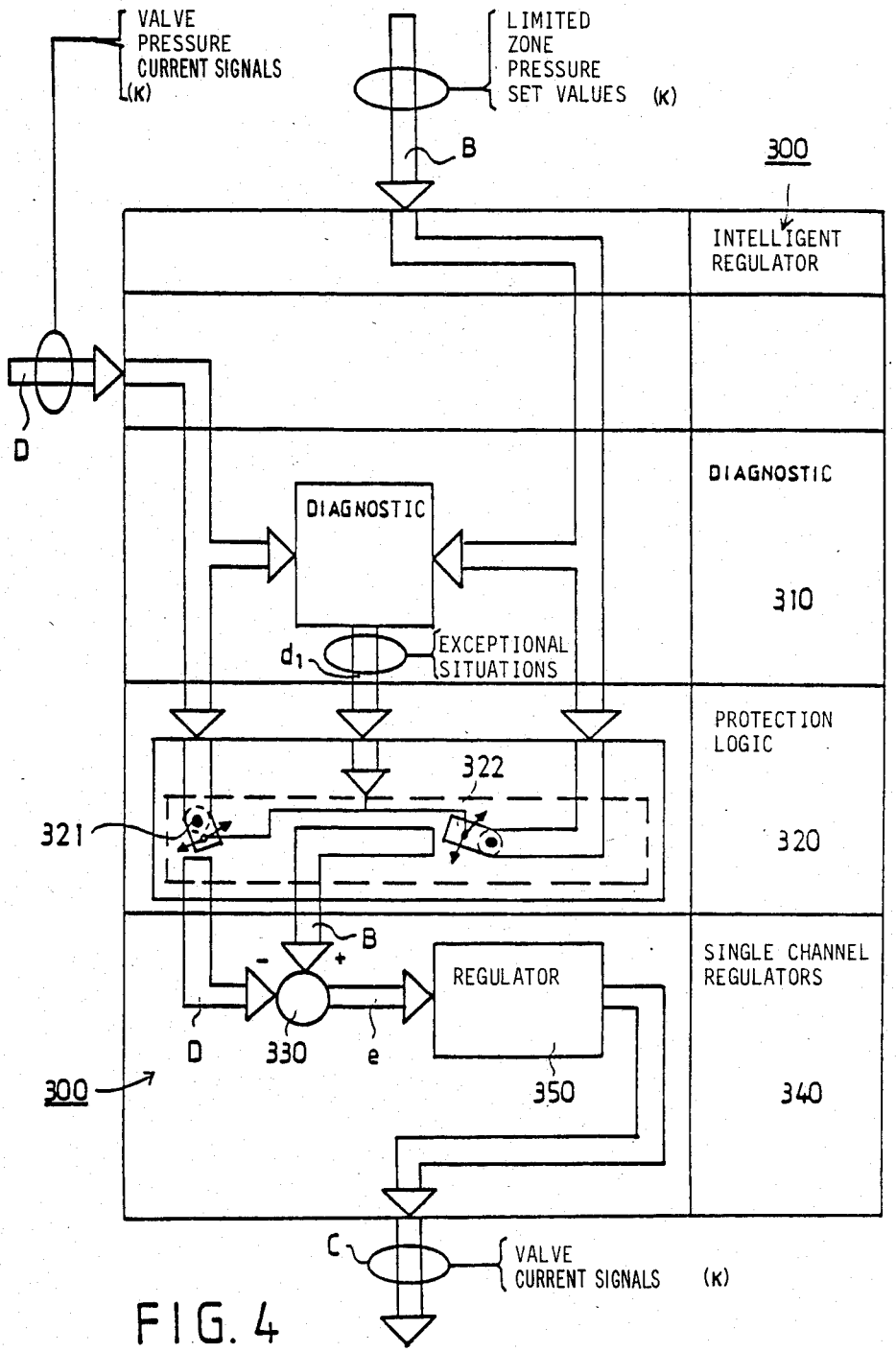
FIG. 4 is a schematic block diagram illustrating a more detailed embodiment of a regulator unit for use with the invention.

Referring to FIG. 4, if the roll 10 operates abnormally, the diagnostic unit 310 of the intelligent regulator 300 detects the abnormal deviation from the valve pressure current signals D generated by the converter unit 420 of the zone pressure actuator unit 400. The diagnostic unit 310 generates control data $d_1$ which is input to protection logic unit 320 of the intelligent regulator 300 which adjusts the limited pressure zone set values B which are input to the regulators 350 in order to protect the roll 10.

Figure 2:
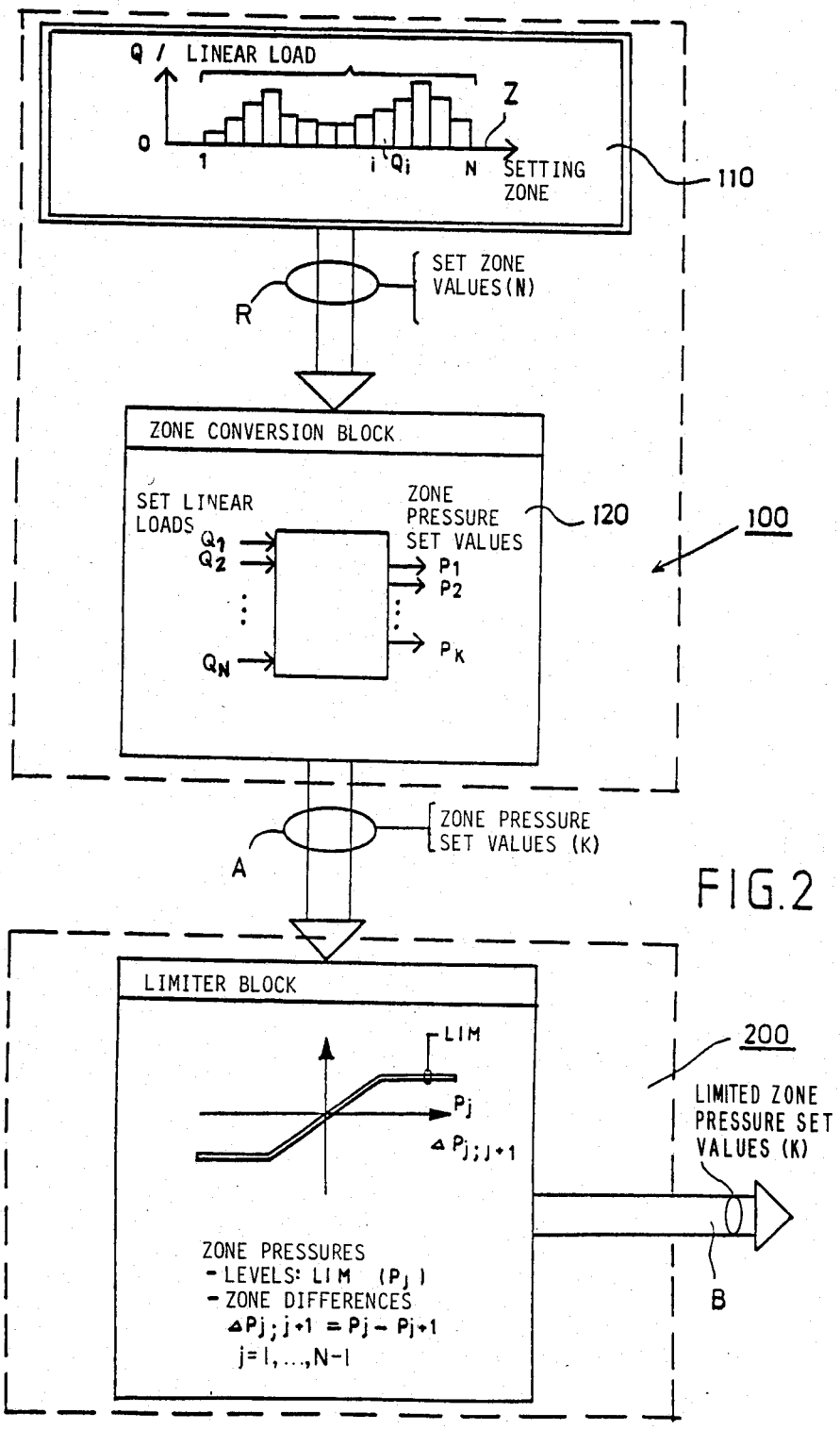
FIG. 2 is a block diagram showing the set value component, including the zone conversion unit, and the linear load limiter unit.

The transmission of erroneous pressure zone set values A for the valves 410 which might damage the roll 10 is initially prevented by limiter unit 200, which, as noted above, limits the set values A between pre-selected maximum and minimum values. Referring to FIG. 2, the zone pressure set values ($P_j$; j=1,2 . . . K) of the K hydraulic valves 410 are limited between certain minimum and maximum pressures MIN (LIM ($P_j$)), MAX (LIM ($P_j$)), wherein j=1,2 . . . K. Moreover, in order to protect the mantle 13 of the zone-adjustable roll 10 from excessive bending, the differences between the pressure zone set values in adjoining pressure zones 16 are limited to a level lower than the permitted limit, $\Delta P_{j;j+1} > [P_j - P_{j+1}]$ wherein j=1, . . . , K−1.

Referring to FIG. 2, the linear load of the zone-adjustable roll 10 is controlled through the adjustment of a setting zone unit 110 of the set value component 100. In particular, the setting zone unit 110 constitutes means by which a desired linear load profile is set in the form of a profile Q(Z) of setting zone set values $Q_i$ (i=1,2 . . . N) for respective N setting zones Z. Thus, the setting zone set value profile Q(Z) of the linear load in the nip $N_o$ formed between the zone-adjustable roll 10 and counter-roll 20 is formed. The influence of the loading cylinders 12*a* and 12*b* are also included in the setting zones Z.

It is an important feature of the invention that the number N of the setting zones Z is substantially greater than the total number K of the actual pressure zones of the zone-adjustable roll, i.e. the number of hydraulic valves 410, i.e., $N>>K$. It follows that the number of pressure zones 16 for the pressure glide shoes 15 is $K-2$, the number of loading cylinders 12*a* and 12*b* being two.

In accordance with the invention, the number N of setting zones Z is preferably chosen so that a corresponding number of linear-load estimation points in the material web W passing between the zone-adjustable roll 10 and counter-roll 20 is sufficient to closely approximate the distribution of the linear load generated at each of the pressure zones 16 on the web W. Generally, the relationship $N=(1.5-3.0)\ K$ provides satisfactory operation and one advantageous choice for the number N of setting zones Z is about twice the total number K of the hydraulic valves 410, i.e., the number of pressure zones ($N\approx 2\times K$). This relationship between the number N of setting zones Z and the number K of pressure zones does not result in an unnecessarily high value of the number N of setting zones from the viewpoint of the time required for the operator to set the desired profile of the setting zone set values.

The number N of setting zones is, generally, within the range of between about 5 to 60, preferably between about 10 to 20, and the number K of pressure zones in the variable-crown roll 10, including the zones for the hydraulic cylinders 12*a* and 12*b* which load the ends of the roll 10, if any, is generally within the range of between about 3 to 20, and preferably between about 6 to 10.

Still referring to FIG. 2, the first number (N) of setting zone set values R of the linear loads or pressures in the setting zones Z are input into the zone conversion unit 120 in which the setting zone set values R of the desired linear load profile Q(Z) of the setting zones Z are converted to the second number (K) of pressure zone set values A, i.e., pressure zone set values $P_1 \ldots P_K$ for the zone valves 410. The conversion of the setting zone set values R to the pressure zone set values A is carried out in accordance with information indicative of the manner in which the system comprising the zone-adjustable roll 10, the counter-roll 20, and the material web W, behaves elastically in response to actual zone pressures $P_v$ and loading pressures $P_a$ and $P_b$. This information can be obtained theoretically and, if necessary, experimentally and can be reduced to the form of a mathematical model which can then be applied in the zone conversion unit 120 such, for example, in the form of a computer program. It will be understood that in the conversion made in the zone conversion unit 120 from the setting zone set values Q(Z) for the N setting zones to the pressure zone set values A for the actual pressure zones, i.e., the number of zone valves 410, no single unequivical correspondence exists. When the important marginal condition is imposed on the conversion which takes place in the zone conversion unit 120 that the current signals C (derived from the pressure zone set values A) for the zone pressures $P_v$ to be obtained, must produce an actual linear-load profile applied to the web W which differs from the desired linear-load or setting zone set value profile Q(Z) set in the setting zone unit 110 substantially minimally, the conversion can be solved in an unequivocal manner. In accordance with the invention, the conversion carried out in the conversion block 120 of the setting zone set values $Q_1 \ldots Q_N$ to the pressure zone set values $P_1 \ldots P_K$ of the zone pressures, wherein $N>>K$, can be accomplished in practice by applying the pseudo-inverse mathematical theory of matrices. Regarding this theory, reference is made to the paper, James A. Cadzow and Hinrich R. Martens, "Discrete-Time and Computer Control Systems," Section 7.6, "Minimum Energy Control", pages 286–293, Prentice-Hall Inc., 1970. More specifically, an equation group used in the mathematical model will comprise a greater number of equations (there are N equations, each corresponding to a respective setting zone set value of the setting zone set value profile corresponding to the desired linear load profile) than unknowns (there are K unknowns, each corresponding to a respective zone pressure) so that no unequivocal solution for the equation group exists. In order to obtain a solution, an additional condition of "minimum energy control" referred to in the above-mentioned Cadzow and Martens paper is imposed which provides a solution for the zone pressures such that the actual pressures deviate minimally in the sense of minimum energy.

The relationship between the desired distribution of the linear load corresponding to the setting zone set value profile Q(Z) and the pressure zone set values is determined on the basis of the physical data of the rolls and of the properties of the material web. This determination can be made, for example, by depicting the zone-adjustable roll 10, counter-roll 20, nip $N_0$ formed between them, and the material web W passing through the nip, in the form of a simplified beam model by which an element model illustrating the nip is obtained, i.e., a certain linear equation group is derived which can be solved by means of matrix algebra while considering the above-discussed marginal conditions.

With the calculated setting zone/pressure zone relationships programmed into zone conversion unit 120, the operator of the regulating system of the invention may provide the nip $N_o$ with the desired distribution of linear load Q(Z). Thus, the operator can directly control a quantity that acts upon the quality of the web thereby making it possible to draw direct conclusions about the relationship between performed control operations and results obtained thereby.

The operator sets the desired linear-load or setting zone set value profile Q(Z) on the basis of the measured transverse profile of the paper. The actual zone pressures required to obtain the desired linear-load distribution that was set are calculated by means of the model illustrating the roll nip $N_o$. In spite of the complexity of the problem, the on-line calculation required in accordance with the model can be simplified to matrix multiplication. The values can be calculated easily by means of a microcomputer.

The mantle 13 of the variable-crown roll 10 and the material web W passing through the nip $N_o$ impose limitations on the allowable changes in the linear load per unit length. Should the desired linear-load profile Q(Z) set by the operator result in excessively large pressure variations in the nip $N_0$, the control system restricts the control to the desired levels before it is carried into effect.

A system in accordance with the invention may thus supervise the operation of the roll equipment. In serious failure situations, the system will control the nip to prevent damage. Thus, the control system does not permit the transmission of pressure zone set values which will cause the zone-adjustable roll 10 or paper web W to become damaged during operation.

Figure 6:
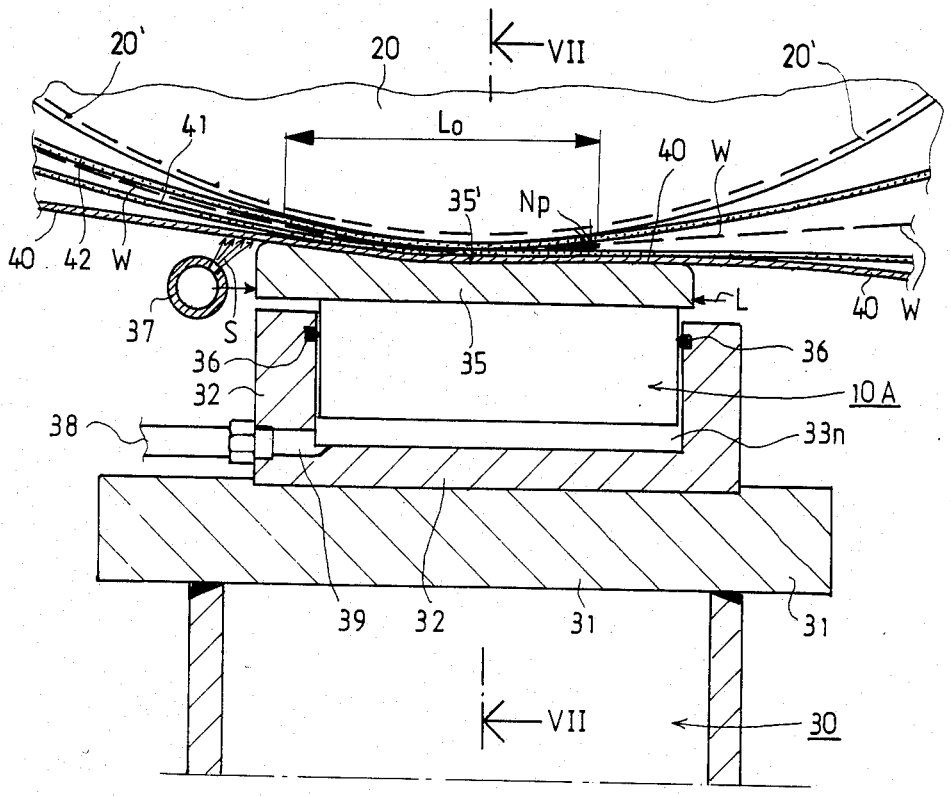
FIG. 6 is a vertical cross-sectional view in the machine direction of an extended nip suitable for regulation in accordance with the invention, FIG. 6 being a cross-sectional view taken along line VI—VI of FIG. 7.
Figure 7:
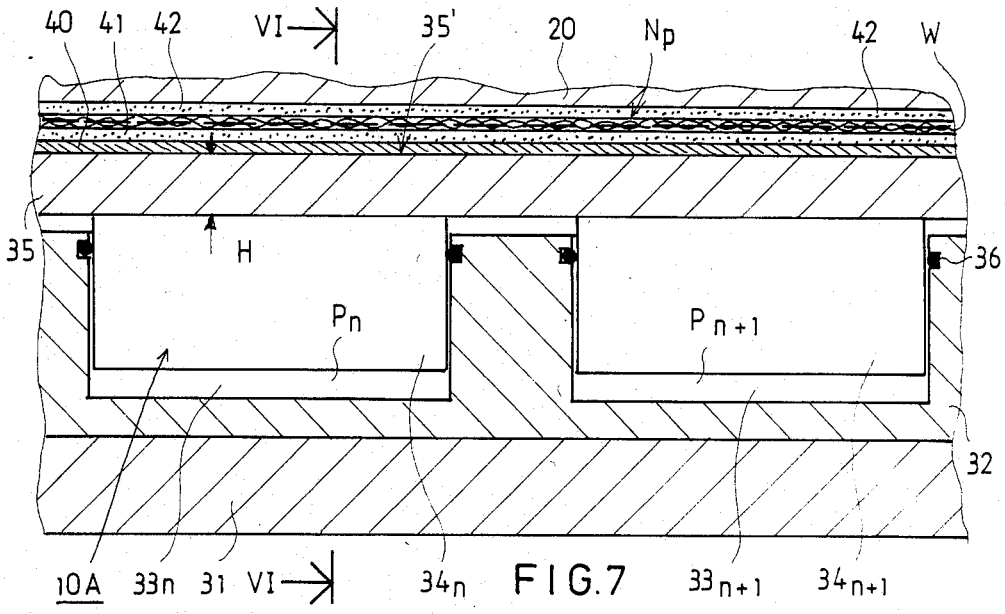
FIG. 7 is section view taken along line VII—VII of FIG. 6.

A regulating arrangement in accordance with the invention also can control an extended nip $N_p$ of the type shown in FIGS. 6 and 7 or the like. The extended nip $N_p$, having a length $L_o$, is formed between a press roll 20 having a hollow face 20' and press shoe 10A. The paper web W runs through the nip $N_p$ between water receiving press felts 41 and 42. Moreover, an impervious looped band 40 acts against the glide surface 35' of the slide piece 35 of the shoe 10A. Lubricant, such as oil or a mixture of water and oil, is fed through a pipe 37 in the direction of arrows S to the inlet side between the looped band 40 and the glide surface 35' of the glide piece 35.

The press shoe 10A is supported on the end flange 31 of the frame beam 30. A cylinder block 32 is attached to the top surface of the flange 31. A series of cylinder bores $33_l \ldots 33_K$ are formed in the cylinder block 32 in the direction of the longer dimension of the nip $N_p$, the bores $33_n$ and $33_{n+1}$ being seen in FIGS. 6 and 7. A series of pistons $34_l \ldots 34_K$ are fitted in respective cylinder bores 33, pistons $34_n$ and $34_{n+1}$ being seen in FIGS. 6 and 7. The sides of the pistons 34 facing the nip $N_p$ are connected to the glide piece 35, the latter being elongate and sufficiently resilient in the direction of the cylinder-piston series 33, 34, so that the pressure distribution in the nip $N_p$ can be adjusted and controlled by means of pressures $P_1 \ldots P_n$, $P_{n+1} \ldots P_K$ passed into the cylinder spaces 33.

Referring to FIG. 6, the length of the glide piece 35 in the running direction of web W is designated L and its thickness is designated H. If $L=k\times H$, the glide piece 35 is, generally, sufficiently flexible if k is in the range of between about 7 to 15, preferably about 10 to 13. The ratio k also depends upon the material of which the glide shoe 35 is formed. The pressures p which are adjusted by means of a regulating system in accordance with the invention are passed into the cylinders 33 via the series of pipes 38 and bores 39. Pistons 34 are sealed by seal rings 36. The length of the glide piece 35 in the transverse direction corresponds to the width of the web W and, as a rule, is on the order of between about 5 to 10 meters.

The press roll 20 shown in FIGS. 6 and 7 may be replaced by a corresponding shoe so that the nip $N_p$ is formed between two opposite press shoes. In such a case, the construction may, for example, be similar to that described in FIG. 7 of Finnish pat. No. 71,369 corresponding to U.S. Pat. No. 4,576,682. Moreover, reference is made to this Finnish patent with respect to the construction and operation of the extended nip $N_p$, such as the distribution of the pressure in the direction of run of the web W.

Returning to FIG. 1, an embodiment of the invention is illustrated in which a feedback unit 500 is used. A detector unit 510 is situated after the nip $N_0$ in the running direction of the web from which a series of measurement signals E are obtained which are passed into the feedback and processing unit 500. The unit 500 generates signals F which are sent to the setting zone unit 110 so that the profile of setting zone set values Q(Z) is obtained directly or indirectly on the basis of the values measured by the detector unit 510 from the web W. The detector unit 510 includes, for example, a number N of measurement detectors 521, . . . 520+N. Detector device 510 may also include more than N detectors, e.g., 2×N detectors, whereupon the necessary conversion, e.g., formation of the average, to a series of N set value signal F may be carried out in the unit 500. A series of fixed detectors 521, may be utilized or, alternatively, it is possible to use a suitable detector device that traverses across the material web W providing either a continuous measurement signal or samples of the web properties in its width direction.

Some of the possible properties of the web W which can be measured in this manner, include, for example, its thickness or caliper, moisture, surface smoothness, glaze, or various combinations of the same. The feedback unit 500 described above and detector devices 510, 520 are often not required or even usable and the invention can be practiced "manually" in which case the operator provides the profile Q(Z) of setting zone set values, the necessary information for which is obtained from other measurement systems of the paper machine or from the after-treatment equipment and/or from the laboratory.

Although the preferred embodiments of the invention have been shown and described above with respect to a zone-adjustable roll 10, it will be understood that it is within the scope of the invention to apply the invention to press shoe devices corresponding to the zone-adjustable roll 10, which generally form extended nips with suitable counter-members, for example, rolls or second shoe devices. Such press shoe devices are known in the prior art in which it is possible to use glide shoes or glide-shoe groups whose pressure actuator units can be controlled by arrangements in accordance with the invention. It is possible to use flexible band loops and/or elastic bands in connection with such press-shoe devices.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. In a method for controlling the pressure profile or transverse distribution of pressure applied to a web passing through an adjustable nip formed between a zone-adjustable device and a counter-member, said zone-adjustable device including a first number (K) of separately adjustable loading means actuated by a first number (K) of separately adjustable actual pressure zones, including the steps of generating a first number (K) of pressure zone set values, inputting said first number (K) of pressure zone set values to regulating means for regulating the pressures of said first number (K) of actual pressure zones in accordance with the values of said first number (K) of pressure zone set values, the improvement comprising an improved method for generating said first member (K) of pressure zone set values, comprising the steps of:

inputting a profile or distribution of setting zone set values corresponding to a desired pressure profile or transverse pressure distribution in the nip into a zone conversion means, said setting zone set value profile or distribution comprising a second number (N) of setting zone set values for a corresponding second number (N) of setting zones;

said second number (N) of setting zones being substantially greater than said first number (K) of separately adjustable actual pressure zones ($N>>K$) of said zone-adjustable device; and converting said second number (N) of the setting zone set values input into said zone conversion means into said first number (K) of pressure zone set values on the basis of a mathematical model of the adjustable nip so that the deviation of the pressure profile or transverse pressure distribution applied to the web passing through the nip from the setting zone set value profile or distribution is substantially minimized.

2. The method of claim 1 wherein said second number (N) of setting zones is in the range of between about 1.5 to 3 times said first number (K) of separately adjustable actual pressure zones, i.e., N=(1.5-3.0) K.

3. The method of claim 1 wherein said second number (N) of setting zones of said setting zone set value distribution is in the range of between about 5 to 60 and wherein said first number (K) of said actual pressure zones is in the range of between about 3 to 20.

4. The method of claim 3 wherein said second number (N) of setting zone of said setting zones set value distribution is in the range of between about 10 to 20 and wherein said first number (K) of said actual pressure zones is in the range of between about 6 to 10.

5. The method of claim 1 wherein after converting said second number (N) of setting zone set values into said first number (K) of pressure zone set values, limiting said pressure zone set values to be within selected maximum and minimum values.

6. The method of claim 1 wherein after converting said second number (N) of setting zone set values into said first number (K) of pressure zone set values, limiting the difference between pressure zone set values of adjoining actual pressure zones to be below a selected maximum value.

7. The method of claim 1 wherein said regulating means comprise intelligent regulator means for diagnosing the operation of the method and controlling any abnormal operation of respective loading means.

8. The method of claim 7 wherein said intelligent regulator means further comprises means for controlling the pressure in said actual pressure zones including a protection logic unit and a first number of channel regulators, said protection logic unit including means for receiving signals indicative of abnormal deviations of pressures of said first number of pressure zones from respective pressure zone set values and means for adjusting the values of said pressure zone set values as a function of said signals.

9. The method of claim 1 including the further steps of measuring the transverse profile of a property of said web after said web passes through said nip and using said web property profile in setting said setting zone set value distribution or profile.

10. A method for regulating the transverse distribution of pressure applied to a web passing through a nip by utilizing a first number (K) of separately adjustable zone power means for a first number (K) of actual pressure zones of the nip, the number of power means loading the nip being sufficiently high to permit the formation of a desired transverse pressure distribution, and wherein said method further utilizes a control system for separately regulating the load applied to the nip by each of said power means, comprising the steps of:

(a) creating a mathematical model of said nip whose transverse pressure distribution applied to said web is to be regulated;

(b) determining a setting zone set value distribution or profile corresponding to a desired pressure profile of said nip comprising a second number (N) of setting zone set values for a corresponding second number (N) of setting zones, said second number (N) of setting zones being substantially larger than said first number (K) of separately adjustable zone power means;

(c) inputting said setting zone set values obtained in step (b) into a zone conversion means for obtaining as an output therefrom a first number (K) of pressure zone set values, so that the deviation of the actual transverse pressure profile acting on the web passing through the nip from the setting zone set value distribution or profile is substantially minimized;

(d) inputting said pressure zone set values into a means of said control system for separately regulating each of said power means as a function of a respective one of said pressure zone set values.

11. The method of claim 10 wherein said regulating means comprises an intelligent regulator provided with diagnostic and protecting means for receiving signals indicative of abnormal deviations of the pressures of said first number of pressure zones from respective pressure zone set values input thereto and for adjusting the values of said pressure zone set values as a function of said signals.

12. In apparatus for treating a web, such as a paper web, passing through an adjustable nip, such as a dewatering nip or a calendering nip, said apparatus including a zone-adjustable device and a counter-member forming said nip, said pressure zone-adjustable device including a first number (K) of nip loading means defining a first number (K) of actual pressure zones in said nip, each of said loading means being loaded by a separately controlled zone pressure which is controlled by a zone pressure controller and a regulating system including a set value unit, a regulator unit, and an actuator unit including a series of said zone pressure controllers and a series of pressure-current converters from which feedback signals are passed to said regulator unit, the improvement comprising:

said set value unit including setting zone means in which a distribution of a second number (N) of separate setting zone set values corresponding to a desired pressure profile in said nip are provided, said second number (N) of separate setting zone set values being substantially greater than said first number (K) of actual pressure zones of said pressure zone-adjustable device, and said set value unit further including zone conversion means for converting said second number (N) of setting zone set values to a first number (K) of pressure zone set values on the basis of a mathematical model of the adjustable nip, whereby the deviation of an actual transverse pressure distribution applied to the web passing through the nip from the setting zone set value distribution is substantially minimized.

13. The improvement of claim 12 wherein said regulator unit comprises an intelligent regulator unit including a diagnostic unit, a protection logic part and a first number of regulators equal in number to said first number (K) of actual pressure zones of said zone-adjustable device connected in parallel and operating independently from each other.

14. The improvement of claim 13 further including detector means for measuring the transverse profile of a property of the web after the web passes through the nip and feedback means for transmitting signals indicative of said transverse property profile of the web to said set value unit to form said distribution of setting zone set values.

15. The improvement of claim 13 wherein said nip comprises an extended nip formed between a shoe arrangement comprising a glide shoe situated within a looped band and a counter-member, and wherein said shoe arrangement further includes a series of cylinder-piston combinations constituting said loading means and into which pressure medium at respective zone pressures is passed, the zone pressure of said pressure medium being controlled by said zone pressure controllers as a function of said pressure zone set values.

* * * * *